United States Patent [19]

Keranen

[11] 4,177,363

[45] Dec. 4, 1979

[54] INTERLOCKING AND MAINTAINING ATTACHMENT FOR TWO STANDARD PUSHBUTTONS

[75] Inventor: John J. Keranen, Sussex, Wis.

[73] Assignee: Eaton Corporation, Cleveland, Ohio

[21] Appl. No.: 881,797

[22] Filed: Feb. 27, 1978

[51] Int. Cl.[2] ..... H01H 9/00; G05G 11/00

[52] U.S. Cl. ..... 200/5 B; 74/483 PB; 200/5 E; 200/50 C; 200/153 G

[58] Field of Search ..... 200/5 R, 5 B, 5 D, 5 E, 200/50 C, 16 A, 76, 153 G, 337, 378, 340; 74/483 R, 483 PB

[56] References Cited

U.S. PATENT DOCUMENTS

| | | | |
|---|---|---|---|
| 2,487,970 | 11/1949 | Horn et al. | 200/5 E |
| 2,930,859 | 3/1960 | Nolden et al. | 200/16 A |
| 3,303,295 | 2/1967 | Davis | 200/5 B |
| 3,391,257 | 7/1968 | Frank | 200/5 E |
| 3,402,620 | 9/1968 | Mukai et al. | 200/5 E X |
| 3,560,677 | 2/1971 | Kolb et al. | 200/5 B X |
| 3,624,321 | 11/1971 | Puetz et al. | 200/337 X |

*Primary Examiner*—James R. Scott

*Attorney, Agent, or Firm*—Hugh R. Rather; William A. Autio

[57] ABSTRACT

Two standard momentary pushbuttons mounted in spaced-part relation on a common support normally directly actuate two switch units, respectively. A maintaining and interlocking attachment is interposed between the pushbuttons and switch units so that when one pushbutton is depressed, it will be maintained depressed and will restore and lock out the other pushbutton so that it cannot be depressed simultaneously. This is done by mounting a plurality of spacer rods between the pushbuttons and their associated switch units to provide space for a bracket secured therein and mounting a dual-spring-biased center-pivoted bistable toggle mechanism having a pair of driven pins, one for each pushbutton. A pair of push-levers are clamped to the standard washer-like drive plates of the respective pushbuttons and are provided with push-flanges and elongated drive slots. The push-flanges actuate the plungers of the respective switch units whereas the elongated slots engage the respective driven pins to move the toggle mechanism from one stable state over its line of action to cause it to snap to its other stable state and be maintained thereat.

15 Claims, 6 Drawing Figures

Fig. 1
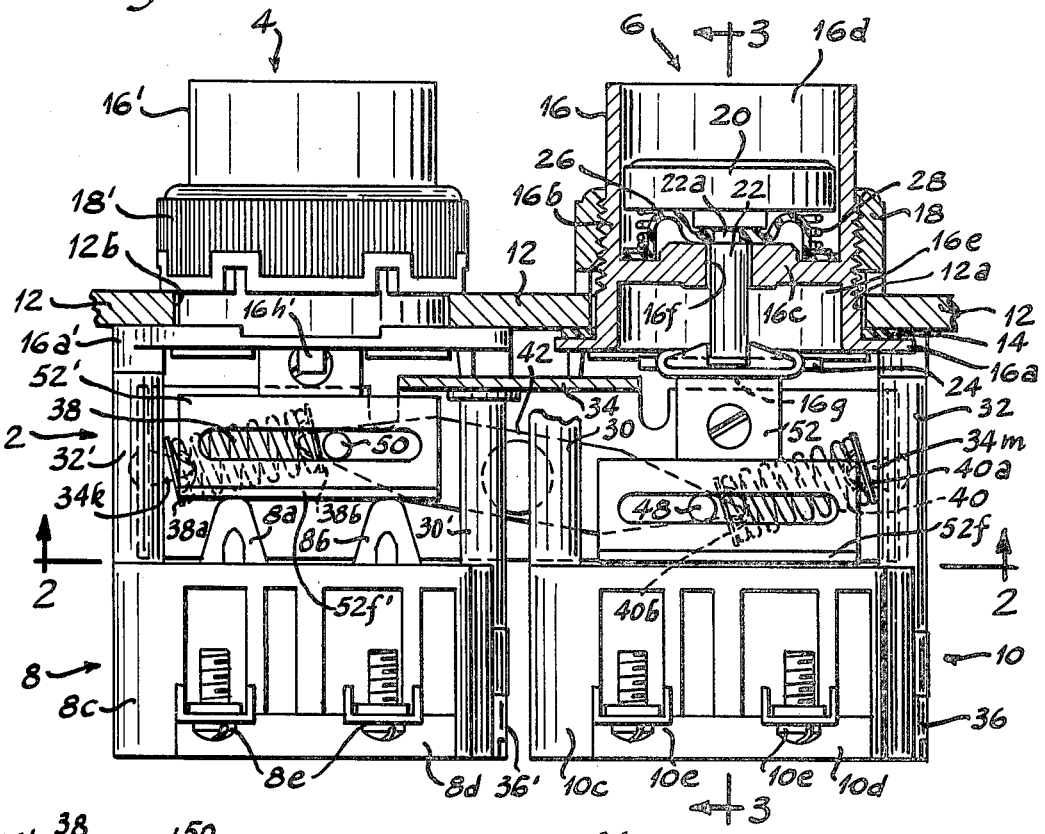
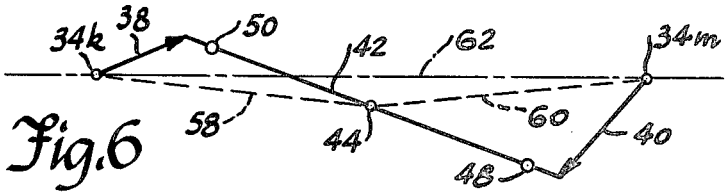
Fig. 6
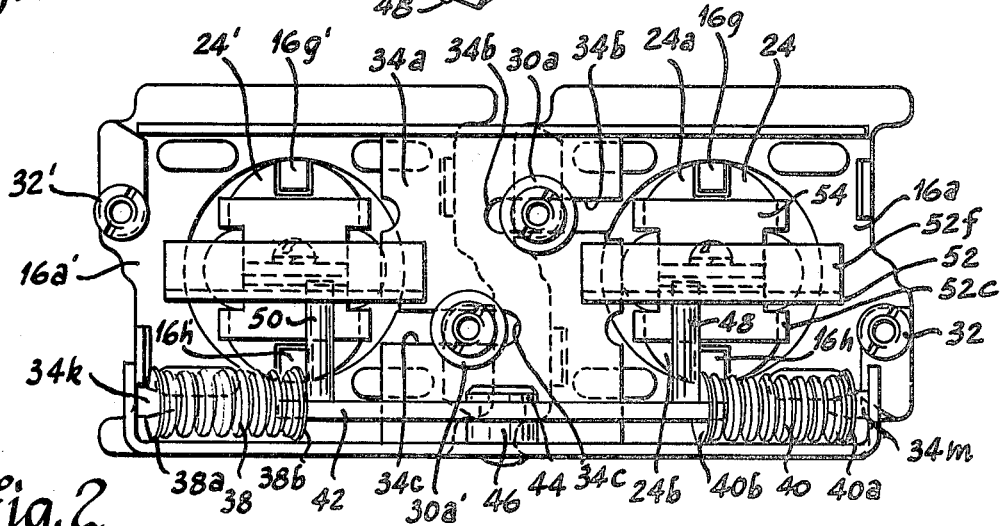
Fig. 2

Fig. 3
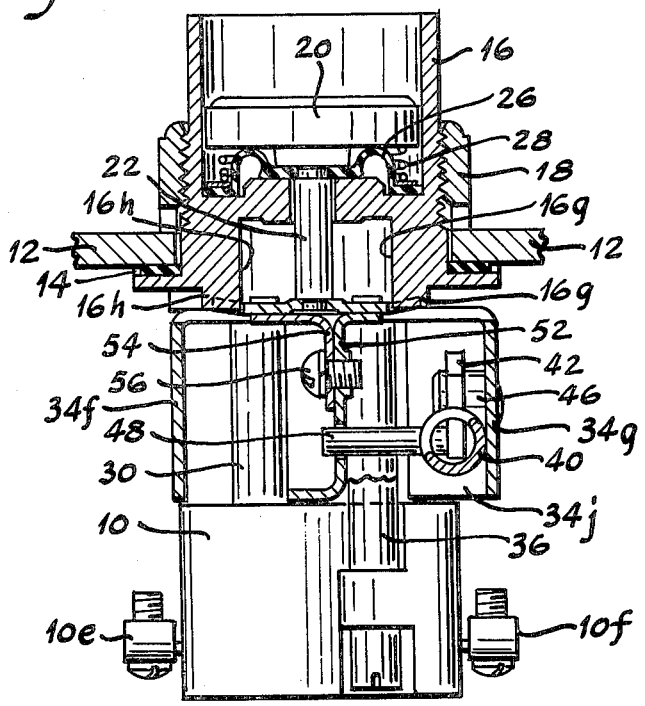
Fig. 4
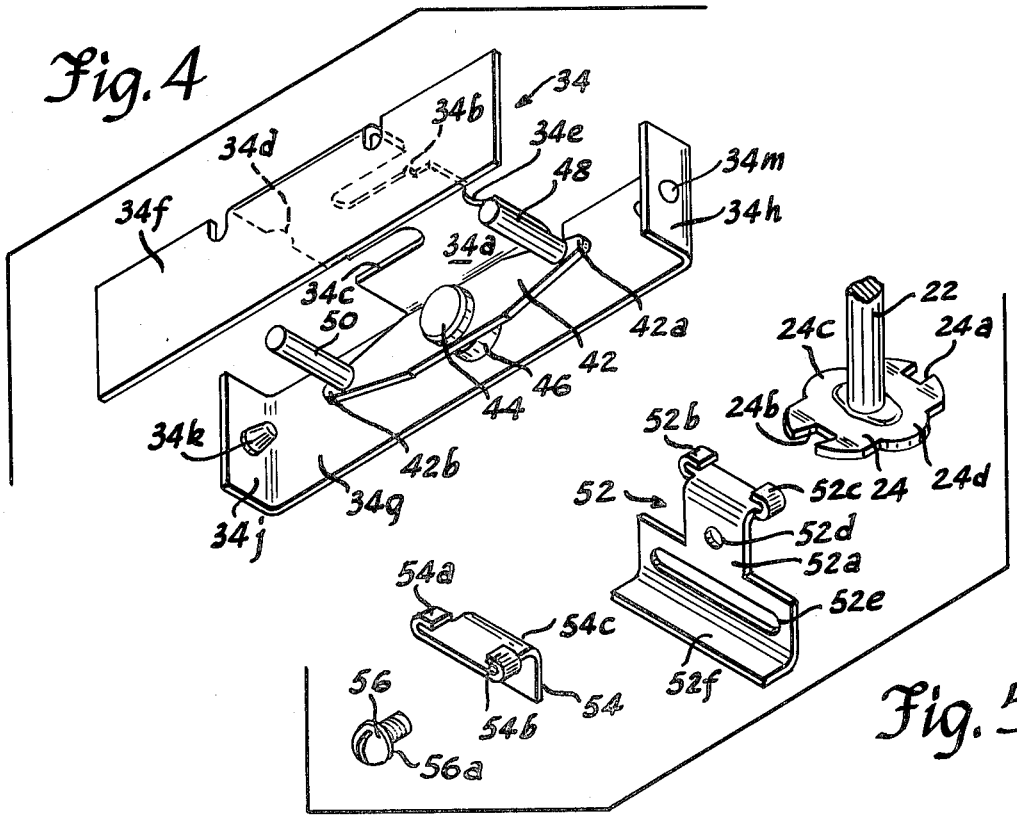
Fig. 5

INTERLOCKING AND MAINTAINING ATTACHMENT FOR TWO STANDARD PUSHBUTTONS

BACKGROUND OF THE INVENTION

Interlocking and maintaining devices for a pair of closely-spaced pushbuttons have been known heretofore. For example, G. B. Horn et al U.S. Pat. No. 2,487,970, dated Nov. 15, 1949, shows a fluorescent lamp switch of the two-button snap-action type having a center-fulcrummed rocker member biased by leaf springs at its ends so as to be maintained in either of two angular orientations. The pushbuttons are coupled to this rocker member by sides of the latter fitting into slots and the rocker member carries a movable contact at one end and depresses a leaf spring movable contact at its other end to actuate the switch. These parts are mounted in a molded switch housing. Also, S. L. Frank U.S. Pat. No. 3,391,257, dated July 2, 1968, shows a maintained-position interlocking mechanism for interlocking a pair of pushbutton switches having L-shaped plate members riveted to the respective pushbuttons and being pin-and slot coupled to opposite ends of a center-pivoted bar. A separate single-spring-biased toggle mechanism is supported on the pushbuttons and is pin and slot coupled to the bar on both sides of its center pivot so as to maintain it in either of its bistable positions to which it is actuated by the pushbuttons.

While these prior devices have been useful for their intended purposes, this invention relates to improvements thereover.

SUMMARY OF THE INVENTION

An object of the invention is to provide an improved interlocking and maintaining mechanism for two pushbuttons.

A more specific object of the invention is to provide an improved interlocking and maintaining attachment for two standard pushbuttons.

Another specific object of the invention is to provide an improved interlocking and maintaining mechanism that may be readily attached to a pair of mounted pushbutton switches of standard type without any structural modification of the latter.

Another specific object of the invention is to provide an improved interlocking and maintaining attachment for two standard pushbuttons that has a plurality of like parts for economical manufacture and symmetrical assembly.

Another specific object of the invention is to provide an improved interlocking and maintaining attachment for two standard pushbuttons that is easy to assemble.

Other objects and advantages of the invention will hereinafter appear.

BRIEF DESCRIPTION OF THE DRAWINGS

FIG. 1 is an enlarged front elevational view, partly in section, of the two pushbutton assembly with the interlocking and maintaining attachment assembled thereto;

FIG. 2 is a horizontal cross-sectional view taken substantially along line 2—2 of FIG. 1 showing a bottom view of the interlocking and maintaining mechanism and the manner of attaching it to the pushbuttons;

FIG. 3 is a vertical cross-sectional view taken substantially along line 3—3 of FIG. 1 showing further details of the interlocking and maintaining attachment;

FIG. 4 is an isometric view of the bracket supported toggle lever subassembly with the two toggle springs and four spring-retainer cups removed;

FIG. 5 is an exploded isometric view of the push-lever and its attaching means and a fragmentary lower, push-plate portion of the pushbutton to which the push-lever is attached; and FIG. 6 is a graph showing the results obtained from lowering the pivot point of the toggle lever.

DESCRIPTION OF THE PREFERRED EMBODIMENT

Referring to FIGS. 1–3, there is shown an interlocking and maintaining attachment, indicated generally as 2, constructed in accordance with the invention and mounted in the space between a pair of pushbutton subassemblies 4 and 6 and their respective switch units 8 and 10, these pushbutton subassemblies being mounted on a flat portion of a supporting member 12 which may be the cover or housing of an electrical control box, or mounting panel, or the like. Pushbutton subassembly 6 is mounted as shown in FIG. 1, by first placing a gasket 14 such as a "neoprene" washer on the lower flange 16*a* of a cylindrical retaining sleeve or ring 16, pushing the upper portion of the retaining ring up through a hole 12*a* in the supporting member, and then turning a nut 18 tight on threaded portion 16*b* of the retaining ring above the supporting member. Pushbutton subassembly 4 is similarly mounted in hole 12*b* which is suitably spaced from hole 12*a* in the supporting member. The interlocking and maintaining attachment is constructed so that the spacing of the mounting holes may be varied within limits as hereinafter described.

Since the two pushbutton subassemblies are similar, only pushbutton subassembly 6 is shown in detail in FIG. 1. Retaining ring 16 is provided with a dividing wall 16*c* thereacross separating the space therewithin into an upper bore 16*d* and a lower bore 16*e*. A pushbutton 20 is vertically movable in the upper bore and has a shaft-like pin or push-rod 22 attached thereto which extends through a hole 16*f* in dividing wall 16*c* and has a washer-like push-plate 24 secured to its lower end within lower bore 16*e* for corresponding up and down movement with the pushbutton. An inverted conical or cup-shaped resilient diaphragm-type sealing member 26 has its lower peripheral flange resting on dividing wall 16*c* and push-rod 22 extends through a hole in its upper portion with the rim of such hole in the sealing member extending into an annular groove 22*a* in push-rod 22 directly below the pushbutton. A pushbutton return spring 28 of the helical compression type surrounds the diaphragm within the upper bore, its lower end pressing the diaphragm flange down against the dividing wall while its upper end bears against and biases the pushbutton upwards.

Reference characters like those used in connection with pushbutton subassembly 6 but with an added prime are used to indicate like parts in pushbutton subassembly 4, such as for example, retaining ring 16′, nut 18′ and push-plate 24′ shown in FIGS. 1 and 2.

As shown in FIG. 5, push-plate 24 rigidly secured to the inner end of pushbutton shaft or push-rod 22 is a standard type. This push-plate has a modified oblong shape with a pair of rectangular notches 24*a* and 24*b*, one at each end, forming keyways that embrace vertical keys 16*g* and 16*h* formed integrally in opposite walls of lower bore 16*e* of the retaining ring as shown in FIGS. 2, 3 and 5. These keys and keyways keep the push-plate from turning. This push-plate is also provided at its opposite sides with substantially semi-circular ears 24*c* and 24*d* having flat lower surfaces that normally abut two operating plungers of a switch unit such as, for example, plungers 8*a* and 8*b* of switch 8 or like plungers (not shown) of switch unit 10 shown in FIG. 1. However, in this embodiment, these ears serve instead to retain the push-lever that is designed to be readily attached thereto as hereinafter described.

Switch units 8 and 10 are provided with insulating, molded housings 8*c* and 10*c*, respectively, that are closed at the bottom with insulating, molded covers 8*d* and 10*d* secured thereto by rivets or the like. Switch unit 8 is provided with a pair of terminals 8*e* extending out from one side and another similar pair of terminals, not shown, extending out from its opposite side that are connected to or integral with two pairs of stationary contacts of a double-pole switch. Each plunger 8*a* and 8*b* carries a movable bridging contact for bridging respective contacts of the pairs thereof. Similarly, switch unit 10 has two pairs of terminals 10*e* extending out on one side and another pair of like terminals 10*f*, FIGS. 1 and 3, extending out from its other side that connect to two pairs of stationary contacts of a double-pole switch while the plungers carry the movable contacts for bridging respective stationary contacts of the two pairs thereof.

As hereinbefore indicated, pushbutton subassemblies 4 and 6 and switch units 8 and 10 are standard types, and are disclosed in more detail in William F. Nolden and Clyde F. Robbins U.S. Pat. No. 2,930,859 dated Mar. 29, 1960.

Instead of the switch units being mounted by their screws directly to the lower flanges of the retaining rings of the pushbutton subassemblies as shown in the aforementioned Nolden et al patent, spacers are interposed to provide space for attaching the interlocking and maintaining mechanism. For this purpose, a pair of spacer rods 30 and 32 are provided for the right-hand pushbutton switch in FIG. 1 and a pair of like spacer rods 30′ and 32′ are provided for the left-hand pushbutton switch. These pairs of spacer rods are provided with reduced-diameter threaded upper end portions so that they can be turned into the screw holes in the flanges of the pushbutton retaiing rings, these flanges having thicker portions to provide room for the necessary tapped screw holes in the standard pushbutton subassemblies. As shown in FIG. 1, spacer rods 30 and 30′ are shorter than spacer rods 32 and 32′ by an amount equal to the thickness of a toggle mechanism supporting bracket 34. Thus, spacer rods 30 and 30′ are used to mount such supporting bracket to the flanges of retaining rings 16 and 16′ as shown in FIG. 1 and nevertheless their lower ends are on a common horizontal plane with rods 32 and 32′ due to this small difference in length so that the switch units can be attached without canting. Spacer rods 30 and 30′ are also provided with respective flanges 30*a* and 30*a*′ immediately adjacent their reduced threaded portions as shown in FIGS. 1 and 2 to insure clamping of the bracket to the pushbutton subassemblies at opposite sides of adjustment slots 34*c* and 34*b* therein. The lower ends of the spacer rods are provided with screwdriver slots whereby they may be turned tight into their tapped holes in the retaining ring flanges. These lower ends are also provided with tapped holes for receiving the pairs of switch unit mounting screws. Thus, switch unit 10 is secured to spacer rods 30 and 32 by mounting screw 36 shown in FIGS. 1 and 3 and a similar mounting screw at its left side. Switch unit 8 is secured to spacer rods 30′ and 32′ by mounting screw 36′ shown in FIG. 1 and a similar mounting screw at its left side.

As shown in FIG. 4, supporting bracket 34 is a generally H-shaped member made of steel or the like. The central connecting portion 34*a* is generally rectangular in form having two elongated, spaced-apart adjustably mounting slots 34*b* and 34*c* therein, slot 34*b* extending toward the left from the right edge thereof and slot 34*c* extending toward the right from the left edge thereof as shown in FIGS. 2 and 4. Spacer rods 30 and 30′ extend through these slots so as to allow centering of the bracket with respect to the pushbutton switches as well as use of this bracket with variably spaced apart pushbuttons within limits. The edges of connecting portion 34*a* are provided with two semi-circular clearance notches 34*d* and 34*e* opposite slots 34*b* and 34*c*, respectively, shown in FIG. 4, to provide clearance for mounting tabs of the attached push-levers when the push-button switches are mounted close together on the mounting panel as hereinafter described.

The two elongated side portions 34*f* and 34*g* of this supporting bracket are bent at right angles in the same direction (down as seen in FIG. 1). Side portion 34*g* is longer than the other one and the opposite end portions 34*h* and 34*j* thereof are bent at right angles inwardly as shown in FIGS. 2 and 4. Tapered pivot pins 34*k* and 34*m* are secured centrally to these bent end portions so that they project toward one another in alignment and form fulcrums for the outer ends of toggle springs 38 and 40 as shown in FIGS. 1 and 2, held thereon by spring guides or cups 38*a* and 40*a*.

An elongated toggle lever 42 is pivotally mounted at its center to the longitudinal center but slightly below the vertical center point of side portion 34*g* of the bracket. For this purpose, a headed shoulder pin 44 extends through a hole at the center of the toggle lever and then through a sleeve spacer 46 and then is riveted to bracket side portion 34*g* so that the toggle lever is free to pivot thereon. Toggle lever 42 has tapered end portions 42*a* and 42*b* as shown in FIG. 4 to provide pivots for the inner ends of toggle springs 38 and 40 which are of the helical compression type and are held thereon by spring guides or cups 38*b* and 40*b*. Suitable flanged cup-like spring guides as aforementioned are placed at both ends of the toggle springs to retain the springs centered and pivotal on fulcrums 34*k* and 34*m* and opposite ends of toggle lever 42. A pair of laterally inwardly extending, driven shoulder pins 48 and 50 are rigidly secured as by riveting near opposite ends of the toggle lever so as to be driven by the push-levers of the pushbuttons as hereinafter described and to drive the toggle lever from one angular position to the other.

Since the switch units have been spaced from the push-button subassemblies in order to provide space for the interlocking and maintaining attachment, push plates 24 and 24′ can no longer reach to actuate the switch plungers such as 8*a* and 8*b* and similar plungers on unit 10. For this reason, push-levers are attached to those push plates to perform the dual function of actuating the switch plungers and also driving the toggle lever in its interlocking and maintaining function. One of these push-levers 52 is shown in FIG. 5 along with its attaching member 54 and clamping screw 56 as well as the washer-like push plate 24 to which it is attached. This push-lever 52 is a generally inverted T-shaped member having a pair of lateral tabs at the upper end of its shank 52*a* which are bent back toward one another to form mounting hooks 52*b* and 52*c* while this end of the shank directly below these tabs is bent at a right angle in one direction. Shank 52*a* has a threaded hole 52*d* for receiving a clamping screw 56 having a lock washer 56*a* thereon as shown in FIG. 5. The lower portion of this push-lever 52 has an elongated horizontal slot 52*e* for cooperating with driven pin 48 to actuate the toggle lever. The extreme lower portion of this push-lever below slot 52*e* is bent at a right angle in the opposite direction to provide an elongated 52*f* for depressing the two plungers of switch unit 10.

Attaching member 54 is similar to the shank portion of the push-lever and has a pair of like mounting hooks 54*a* and 54*b* except that the right angle bend 54*c* therein is farther from these hooks so that when it is assembled with the push-lever on push plate 24, flange 52*f* will be centered with respect to the latter and thus will centrally engage the switch plungers. Also, the hole in attaching member 54 is unthreaded so that screw 56 passes freely therethrough. As shown in FIGS. 1 and 2, the two hooks of the push-lever are slid over one slotted end of push plate 24 and the two hooks of the attaching member are slid over the other slotted end thereof whereafter screw 56 is inserted through the hole in member 54 and turned tight in threaded hole 52*d* to clamp the two parts together with their pairs of hooks against the opposite sides of ears 24*c* and 24*d* of the push plate. As a result, the push-lever is rigidly secured to the push plate, push flange 52*f* is centered with respect to the pushbutton as shown in FIGS. 2 and 3 and also with respect to the switch plungers, and slot 52*e* is offset toward toggle lever 42 as shown in FIG. 3 to insure engagement with driven pin 48. As shown in FIGS. 1–3, driven pin 48 extends through slot 52*e* and is driven whenever the corresponding pushbutton is depressed to snap this end of the toggle lever down.

The push lever, attaching member and clamping screw for the left-hand pushbutton switch in FIGS. 1 and 2 is similar so that it will not be described in detail.

From the foregoing, it will be apparent that the interlocking and maintaining attachment can be readily assembled onto a pair of pushbutton switches that are mounted on a common panel or switch enclosure housing or cover. First, the hooks of the push-levers and their respective attaching members are slid onto the standard push plates 24 and 24′ and their clamping screws are turned tight. Then the pushbutton subassemblies are inserted into their holes in the mounting panel and their respective mounting nuts 18 and 18′ are turned tight. Next, the toggle springs and their spring guides or cups are assembled between the opposite ends of toggle lever 42 and their fulcrums on bracket 34. While the toggle lever is gripped to hold this subassembly to prevent the parts from becoming dislodged, the bracket is placed in position against the retaining ring flanges 16*a* and 16*a*′ and driven pins 48 and 50 are simultaneously inserted in the drive slots, such as 52*e*, of the push-levers whereupon the toggle lever may be released while the bracket is still held in place. Then spacer rods 30 and 30′ are inserted through the slots in the bracket, the bracket centered and these spacer rods turned tight to rigidly secure the mounting bracket of the toggle mechanism in place. Next, spacer rods 32 and 32′ are turned into the holes in the retaining ring flanges using the screwdriver slots at their lower ends. Finally, switch units 8 and 10 are placed on the pairs of spacer rods and their pairs of screws turned tight into the tapped lower ends of the spacer rods to complete assembly of the combination.

Referring to FIG. 1, it will be seen that the right-hand pushbutton is down while the left-hand pushbutton is up. Toggle lever 52 is at an angle whereby toggle springs 38 and 40 act therethrough and through driven pins 48 and 50 to hold the right-hand pushbutton down and to bias the left-hand pushbutton up. When the left-hand pushbutton is pressed downward until the pivot between the left end of the toggle lever and spring 38 crosses the straight-line line of action, that is, crosses over-center at maximum compression of spring 38, the mechanism automatically "toggles", whereby spring 38 accelerates the downward movement of the left end of the toggle lever. Pin 50 drives push-lever 52′ down, depressing the plungers of switch unit 8, until push flange 52*f*′ bottoms against the top of the switch unit housing. This causes closure of the two poles of switch unit 8 if they are of the normally-open type, or opening thereof if they are of the normally-closed type.

At the same time, the right-hand end of the toggle lever is driven up whereby pin 48 lifts the right-hand pushbutton, thus allowing the plungers of switch unit 10 to restore and to also restore the double-pole contacts thereof to normal position.

As hereinbefore mentioned, the pivot point of the toggle lever is a predetermined amount lower than spring fulcrums 34*k* and 34*m* to improve the operation of the pushbutton switches. This affords two advantages. It enhances the ability of the mechanism to inhibit "teasing" of the contacts and lengthens the depressing stroke of the push-levers thereby to insure depressing of the plungers flush with the top of the switch unit housing, thus providing good contact pressure for normally-open contacts. FIG. 6 shows graphically how these improved results are accomplished. This graph depicts toggle springs fulcrums 34*k* and 34*m*, toggle springs 38 and 40, toggle lever 42 and its center pivot pin 44, driven pins 48 and 50 mounted on the toggle lever, and in broken lines, the left overcenter line-of-action 58 and the right overcenter line-of-action 60.

As shown in this graph, toggle lever 42 pivot point 44 is below the level 62 of toggle springs fulcrums 34*k* and 34*m* by a predetermined distance, this distance being exaggerated in this graph for clarity.

Considering first how the system would have functioned if toggle lever pivot point 44 had been placed in line with the toggle springs fulcrums 34*k* and 34*m* at level 62. Under this condition, level 62 would be the overcenter line-of-action of both the left and right sides of the toggle mechanism and the system would be in balance because both toggle springs are compressed the same amount at any position. Such balanced condition might make the toggle system susceptible to "teasing" of the switch units contacts, that is, holding both pushbuttons so that the contacts touch lightly. This is undesirable because it causes arcing, heating and deterioration of the contacts. Also, driven pin 48 would go no further below level 62 than driven pin 50 is above level 62 which would afford an inadequate push stroke for the switch unit plungers and thus might not afford sufficient contact pressure.

On the other hand, with pivot point 44 lowered below level 62 as roughly depicted in FIG. 6, these problems are overcome. The overcenter line-of-action at the left side is now moved to broken line 58 and the overcenter line-of-action at the right side is now moved to broken line 60 from line 62. Driven pin 50 is now only a slightly greater distance above its line-of-action 48 whereas driven pin 48 is now a much larger distance below its line-of-action 60. This, of course, means that for only a slightly longer pushbutton stroke to cause one side of the toggle mechanism to cross its line-of-action, the system will toggle to drive the respective driven pin through a much longer contact plunger actuating stroke. Moreover, the forces are unbalanced at all times to effect a toggling action affording good, clean and sharp tactile sensibility. This arrangement puts the longer stroke into the plunger operation where it is needed to insure closure of normally-open contacts plus sufficient contact pressure. Also, this arrangement tends to inhibit "teasing" of the contacts because the forces are unbalanced. This unbalance is apparent in FIG. 6 where toggle spring 38 is compressed more and thus is shorter than toggle spring 40 in the position shown. Then when the left side is depressed to its line-of-action 58 for maximum compression of spring 38, the right side has not risen to its line-of-action 60 and toggle spring 40 is not fully depressed. When the left side crosses its line-of-action 58, the greater force in spring 38 accelerates it down and the momentum of the parts carries the right side over its line-of-action 60 whereupon the left driven pin 50 provides the longer stroke to actuate the switch plungers all the way down. Such full depression of the switch plungers is shown with respect to push flange 52*f* at the right side of FIG. 1.

While the apparatus hereinbefore described is effectively adapted to fulfill the objects stated, it is to be understood that the invention is not intended to be confined to the particular preferred embodiment of interlocking and maintaining attachment for two standard pushbuttons, inasmuch as it is susceptible of various modifications without departing from the scope of the appended claims.

I claim:

1. An interlocking and maintaining attachment for two standard pushbutton devices of the type having a shaft-mounted pushbutton vertically reciprocable in a retaining ring with a standard push-plate secured to the lower end of the shaft and the pushbutton devices being mounted by their retaining rings in spaced apart relation on a common supporting member, comprising:

push-levers attached at their upper ends to respective push-plates on the pushbutton devices with their lower ends extending downwardly and having means for actuating driven units;

and a toggle mechanism including supporting means therefor mounted below said pushbutton devices comprising:

an elongated toggle lever pivotally mounted intermediate its ends on said supporting means;

toggle springs in compression between said supporting means and points on said toggle lever spaced on opposite sides of its pivot biasing said toggle lever in one or the opposite pivotal direction according to its angular state;

and means coupling said push-levers to said toggle lever at respective locations spaced on opposite sides of its pivot so that upon depression of one pushbutton, its push-lever drives the corresponding side of the toggle mechanism downwardly across its overcenter line of action whereupon said toggle mechanism snaps to its limit of downward motion carrying the corresponding push-lever and pushbutton with it while the other side of the toggle mechanism raises the other pushbutton, and said toggle mechanism thereafter maintains the pushbuttons in their respective down and up states.

2. The interlocking and maintaining attachment claimed in claim 1, wherein:

said supporting means for said toggle mechanism comprises:

a supporting bracket;

and means for securing said supporting bracket to the retaining rings of the pushbutton devices.

3. The interlocking and maintaining attachment claimed in claim 2, wherein:

said supporting bracket comprises an elongated member having a lateral portion at each end with fulcrums on the respective lateral portions directed toward one another;

and said toggle springs are helical springs in compression between the respective fulcrums and said points on said toggle lever.

4. The interlocking and maintaining attachment claimed in claim 1, wherein:

said points on said toggle lever are tapered ends of said toggle lever on which said helical springs are pivoted.

5. The interlocking and maintaining attachment claimed in claim 4, wherein:

said means coupling said push-levers to said toggle lever at respective locations spaced on opposite sides of its pivot comprises locations between said pivot and opposite ends of said toggle lever.

6. The interlocking and maintaining attachment claimed in claim 1, wherein:

said means on said push-levers for actuating driven units comprises an elongated right-angle flange at the lower end of each push-lever for depressing driven unit actuators.

7. An interlocking and maintaining attachment for two standard pushbutton switches of the type having a shaft-mounted pushbutton mounted for limited vertical reciprocation in a flanged guiding and retaining member with a standard push-plate secured to the lower end of the shaft for actuating the plungers of an associated switch unit, and the pushbutton switches being mounted by their flanged guiding and retaining members in spaced-apart relation through holes in a common supporting panel, comprising:

two push-levers removably clamped at their upper ends to the respective standard push-plates of the pushbutton switches with their lower ends extending downwardly and having push means for actuating the switch units;

spacer means secured to the flanged guiding and retaining members for securing and spacing the switch units therebelow to provide space therebetween for said interlocking and maintaining attachment;

and a toggle mechanism comprising:

a supporting bracket in said space;

means securing said supporting bracket to said flanged guiding and retaining members;

an elongated toggle lever pivotally supported at its mid-portion on said supporting bracket;

fulcrums on said supporting bracket directed toward one another on a common plane;

toggle springs pivotally supported in compression between said fulcrums and opposite end portions of said toggle lever biasing said toggle lever in one or the opposite pivotal direction according to its angular state;

and motion converting means coupling said push-levers to said toggle lever at opposite sides of its pivot so that upon depression of either pushbutton, its push-lever drives the corresponding side of the toggle lever downwardly, compressing the associated toggle spring, across its overcenter line of action, and drives the other side of the toggle lever upwardly, whereupon said associated toggle spring being fully compressed accelerates said corresponding side of said toggle lever and snaps it to its limit of downward motion to effect full actuation of the associated switch unit, and the other side of the toggle lever and its toggle spring pass over their overcenter line of action and raise the other pushbutton whereafter said toggle mechanism maintains the pushbuttons in their respective down and up positions.

8. The interlocking and maintaining attachment claimed in claim 7, wherein:

each push-lever comprises a push member having a pair of hooks slid over one end of the standard push-plate and a clamping member having a like pair of hooks slid over the other end thereof and a screw securely drawing said push member and said clamping member together.

9. The interlocking and maintaining attachment claimed in claim 7, wherein:

said spacer means comprises a pluraity of spacer rods secured at one end to the flanged guiding and retaining members and having said switch units secured to their other ends.

10. The interlocking and maintaining attachment claimed in claim 9, wherein:

said means securing said supporting bracket to said flanged guiding and retaining members comprises slots in said bracket and at least some of said spacer rods extending through said slots and having shoulders for clamping said bracket to said flanged guiding and retaining members.

11. The interlocking and maintaining attachment claimed in claim 10, wherein:

the shouldered ends of said spacer rods are threaded into said flanged guiding and retaining members and the other ends thereof are tapped to receive mounting screws of the switch units whereby said bracket may be readily attached to the pushbutton switches.

12. The interlocking and maintaining attachment claimed in claim 7, wherein:

said elongated toggle lever is pivotally supported on said supporting bracket a predetermined distance below said common plane of said toggle springs fulcrums.

13. The interlocking and maintaining attachment claimed in claim 7, wherein:

said motion converting coupling means comprises pin and slot connections between said push-levers and said toggle lever to convert linear motion of said push-levers into pivotal motion of said toggle lever.

14. The interlocking and maintaining attachment claimed in claim 13, wherein:

the pins of said pin and slot connections are rigidly secured to said toggle lever and arranged laterally with respect thereto and said slots are arranged horizontally on the lower end portions of said push-levers.

15. The interlocking and maintaining attachment claimed in claim 10, wherein:

said motion converting coupling means comprises lateral pins extending from said toggle lever and slots on said push-levers into which the respective lateral pins extend for coupling purposes;

and said slots in said bracket and said slots in said push-levers are elongated in a direction parallel to the center-line through the two pushbutton switches to afford adjustment of said toggle mechanism with respect to the pushbutton switches and allow variable spacing of the pushbutton switches on the common supporting panel.

* * * * *